United States Patent [19]

Sweers

[11] 4,271,643

[45] Jun. 9, 1981

[54] EAVES TROUGH MOUNTING ADAPTER

[76] Inventor: Ronald L. Sweers, 6165 E. Atherton, Flint, Mich. 48507

[21] Appl. No.: 88,051

[22] Filed: Oct. 24, 1979

[51] Int. Cl.[3] ..... E04D 13/04

[52] U.S. Cl. ..... 52/11; 52/95; 248/48.1

[58] Field of Search ..... 52/11–16, 52/95; 248/48.1

[56] References Cited

U.S. PATENT DOCUMENTS

| | | | |
|---|---|---|---|
| 471,356 | 3/1892 | Gibbons . | |
| 667,821 | 2/1901 | Fingles . | |
| 2,641,203 | 6/1953 | Coleman | 52/11 |
| 2,784,687 | 3/1957 | Hovey . | |
| 2,943,421 | 7/1960 | Squires | 52/11 |
| 3,057,117 | 10/1962 | Singer | 52/11 |
| 3,098,322 | 7/1963 | Greene | 52/11 |
| 3,344,562 | 10/1967 | Miles | 52/11 |
| 3,436,877 | 4/1969 | Gunning | 52/11 |
| 3,545,144 | 12/1970 | Sickler | 52/11 |
| 3,550,381 | 12/1970 | South | 52/11 X |

*Primary Examiner*—J. Karl Bell

*Attorney, Agent, or Firm*—Gifford, VanOphem, Sheridan & Sprinkle

[57] ABSTRACT

An adapter which facilitates the securing of an eaves trough to a roof of a building. The adapter, preferably a one-piece structure, has a substantially flat roof engaging flange extending inwardly from the edge of the roof; a substantially flat drip flange extending outwardly from the edge of the roof; and first and second downwardly extending and spaced apart flanges which define an open bottomed channel for receiving the wall of the eaves trough therein, wherein said first flange is adjustable with respect to said roof engaging flange by bending while said first and second flanges remain substantially parallel.

5 Claims, 3 Drawing Figures

Fig-1
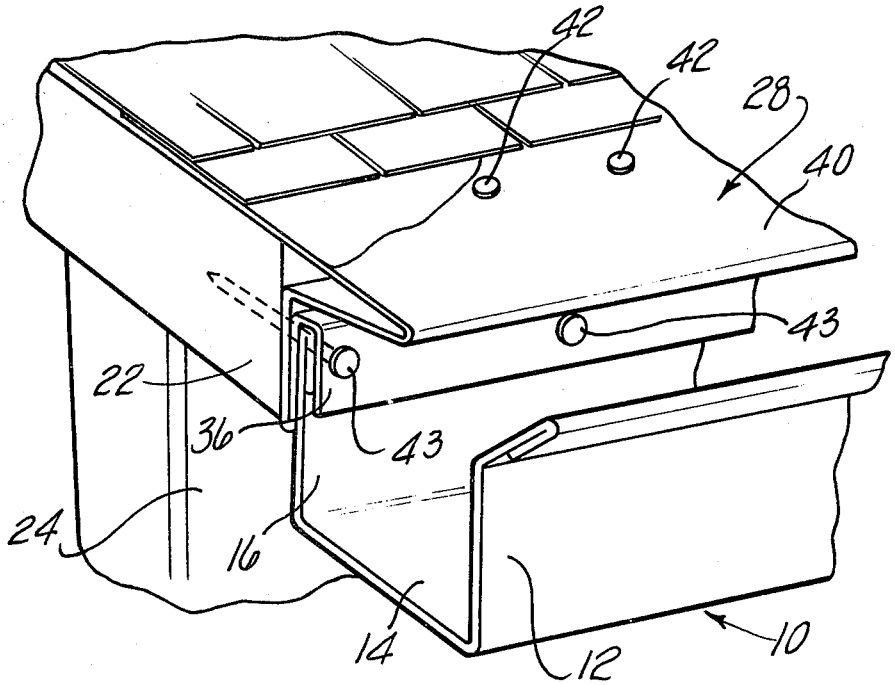
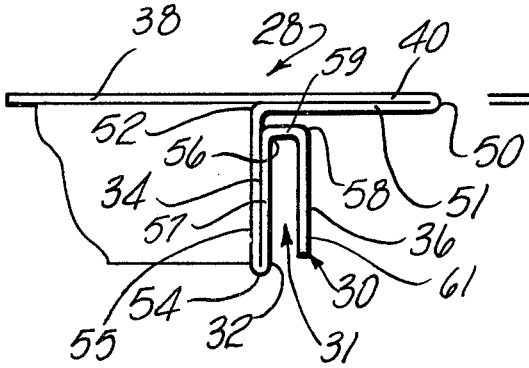
Fig-2
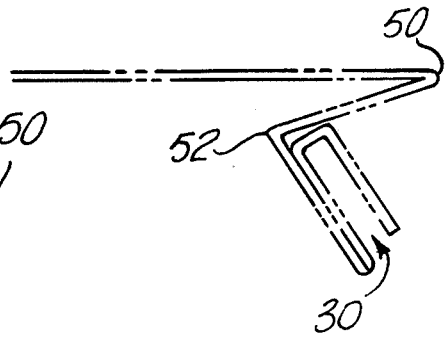
Fig-3

EAVES TROUGH MOUNTING ADAPTER

BACKGROUND OF THE INVENTION

I. Field of the Invention

The present invention relates to rain gutters or eaves troughs and, more particularly, to an adapter which facilitates mounting an eaves trough to a building.

II. Description of the Prior Art

Prior art eaves trough mounting adapters usually comprise a single downwardly extending flange which, if the adapter is properly installed, is spaced from a vertical surface adjacent the roof in a manner to provide a space into which the wall of the eaves trough can fit. However, the workmen who usually install such adapters oftentimes install them such that the downwardly extending flange is too close to the vertical wall adjacent the roof, making it impossible to insert the wall of the eaves trough into the space between the flange and the building. As a result, the wall of the eaves trough is placed outside the flange, which allows water draining from the roof to seep between the wall of the eaves trough and the flange and then to flow downwardly over the building wall surface causing the latter to become stained and dirty.

Alternative prior art adapters include very complicated devices which can be used only with specially designed or non-conventional eaves troughs. Such eaves troughs are much more expensive to manufacture than conventional ones. Further, from a practical viewpoint, it is very difficult to locate a source of a particular custom made or nonconventional eaves trough when replacement parts are needed.

There is, therefore, a need for an eaves trough mounting adapter, particularly for conventional eaves troughs, which can be installed on a roof easily, quickly, inexpensively, and in a manner to prevent water seepage down the walls of the building.

SUMMARY OF THE INVENTION

The present invention is an adapter useful particularly for mounting a conventional, generally U-shaped eaves trough, to a roof of a building, which overcomes the aforementioned disadvantages of the prior art adapters.

The adapter of the invention includes a channel means having a generally downwardly facing opening which is connected to the roof and receives one wall of the eaves trough therein. The adapter further includes means positioned above the channel means which conducts water draining from the roof past the channel means and into the eaves trough. More specifically, the adapter includes a generally flat roof engaging flange which extends inwardly from the edge of a building roof and a coplanar drip flange which extends outwardly from said roof edge. Two spaced apart flanges extend generally downwardly from the drip flange and define a channel with a downwardly facing opening. Preferably, the adapter is integrally formed from a single sheet of material, such as aluminum, and includes means for adjusting the angle between the roof engaging flange and the channel so that the adapter can be used regardless of the pitch of the roof.

The relative directional terms "above" and "downwardly", as used herein, refer to the functional position of the adapter as it is connected to the roof and as it appears in the drawings.

Conventional eaves troughs are generally U-shaped or V-shaped in cross section and are adapted to receive water draining from a sloped roof and to serve as a conduit for the water to a vertical drain pipe. One wall of the trough is normally positioned near or against a building and normally is positioned immediately below the edge of the roof. The latter wall is referred to herein as the inner wall of the trough.

The width of the channel means defined by the downwardly extending flanges is not considered critical to the adapter except that it must be of a sufficient width to receive the inner wall of a conventionally shaped eaves trough therein. It is preferred that the width of the channel be only slightly larger than the thickness of the inner wall of the eaves trough for ease of installation and to present a more finished appearance following installation.

BRIEF DESCRIPTION OF THE DRAWINGS

A better understanding of the present invention will be had upon reference to the following detailed description of the preferred embodiment when read in conjunction with the accompanying drawing in which like reference characters refer to like parts throughout the several views and in which:

FIG. 1 is a perspective view of a portion of a roof structure having a conventional U-shaped eaves trough mounted thereto by means of a preferred embodiment of the adapter of the present invention; and FIG. 2 is a cross sectional view of the adapter of FIG. 1 and enlarged for clarity; and FIG. 3 is a sectional view similar to FIG. 2 but showing the adapter adjusted in a second position so as to engage a roof having a slope different from that shown in FIG. 2.

DESCRIPTION OF THE PREFERRED EMBODIMENT

Referring now to FIG. 1, a section of a conventional eaves trough 10 having a generally U-shaped cross sectional shape comprising a front wall 12, bottom wall 14 and inner wall 16 is shown mounted to a building roof 20 in front of a building fascia board 22 extending longitudinally along a top edge of a building wall 24.

Referring to both FIGS. 1 and 2, an adapter 28 for mounting the eaves trough 10 to the roof 20 is shown and includes a channel member 30 having a channel 31 with a downwardly facing opening 32 formed between two spaced apart, parallel, downwardly extending flanges 34 and 36. The adapter 28 further includes a roof engaging flange 38 which extends inwardly from the roof edge and at a predetermined angle with respect to the flange 34. The predetermined angle, which is determined by the slope of the roof will be discussed in greater detail hereinafter. Shingles extend over and cover the upper edges of the roof engaging flange 38.

A drip flange 40 extends outwardly from the edge of the roof such that it projects over a portion of the opening of the trough 10. Preferably, the roof engaging flange 38 and drip flange 40 are coplanar for ease of manufacture and to avoid creating an obstacle to the flow of water downward along the roof.

As best shown in FIG. 2, the preferred embodiment of the adapter 28 is formed from a single elongated sheet of resilient but deformable material which is bent to form the particular flanges. The adapter comprises substantially five bends 50, 52, 56 and 58. The sheet is initially bent substantially 180° at bend 50 so that a second portion 51 of the sheet between the bends 50 and 52 extends substantially adjacent and parallel to the drip flange 40.

A third portion 55 of the sheet depends perpendicularly downwardly from the second portion 51 at the bend 52 and terminates at the bend 54. At bend 54, the sheet is bent substantially 180° to the right as viewed in FIG. 2 so as to form a fourth portion 57 which extends adjacent and parllel to the third portion 55 of the sheet. The third and fourth portions 55 and 57 of the sheet together define the first depending flange 34.

The fourth portion 57 terminates at the bend 56 where the sheet is bent substantially 90° to the right as viewed in FIG. 2 to form a fifth portion 59 extending between the bends 56 and 58. At bend 58, the sheet is bent substantially 90° to form a sixth portion 61 which depends downwardly from the fifth portion and is substantially parallel to the fourth portion 57 of the sheet. This sixth portion 61 of the sheet defines the downwardly extending flange 36. Thus, the fourth, fifth and sixth portions of the sheet define the channel member 30 intermediate the flanges 34 and 36.

It is important to note that the previously-described angular dimensions of the bends 50 and 52 have been described as "initial" dimensions. These previous values define the maximum limits that would be required for these angles. As will be seen, it is an important feature of the present invention that these angles are easily adjustable so that regardless of the particular slope of the roof to which the adapter is to be secured, the appropriate predetermined angle between the roof engaging flange 38 and depending flange 34 can be obtained by manually bending the adapter 28.

Moreover, while the flange 34 can be positioned to flatly abut against the fascia board 22 so that it is disposed at the appropriate predetermined angle with respect to the roof engaging flange 38, flanges 34 and 36 remain substantially parallel and appropriately spaced apart to permit easy installation of the eaves trough wall 16 therebetween. Consequently, the conventional eaves trough can be easily mounted in its normal upright position. In order to facilitate bending of the adapter at bend 52 without reorienting the flanges 34 and 36 with respect to each other, it is preferable to provide a space between the second portion 51 and fifth portion 59 of the sheet as shown in FIG. 2.

To mount the eaves trough 10 to a roof 20 using the adapter 28, the roof engaging flange 38 is placed over the roof 20 adjacent the edge of the roof along which the eaves trough 10 is to be mounted. The flange 38 is forcibly urged upward against the roof 20 until the flange 34 extends downwardly and abuts flatly against the vertical surface of fascia board 22. Since the adapter 28 is made of a resilient but deformable material, such forcing decreases the angles at either or both bends 50 and 52 until the appropriate predetermined angle between the flange 38 and flange 34 is attained, as shown in FIG. 3. The roof engaging flange 38 is then secured to the roof 20 by, for example, conventional nails 42, and roof shingles overlay the flange 38 to prevent water seepage between the roof 20 and flange 38. The adapter 28 is thus attached to the roof such that flanges 36 and 38 extend longitudinally along the entire length of the roof, or to a shorter length to accommodate the length of the required eaves trough.

Next the inner wall 16 of the eaves trough 10 is inserted upwardly into the channel 31 and is secured in place by, for example, conventional nails 43 which pass through the flanges 34 and 36, the inner wall 16 of the eaves trough 10, and into the fascia board 22 of the roof 20. Since the flanges 34 and 36 have not been displaced with respect to each other, the insertion of the inner wall 16 into the channel 31 can be quickly and easily accomplished.

The drip flange 40 overlays a portion of the eaves trough opening and serves to convey water draining from the roof directly into the eaves trough 10.

The flange 36 prevents water that drains off the roof into the eaves trough 10 from seeping between the inner wall 16 of the eaves trough 10 and the fascia board 22, thus, preventing the staining of the fascia board 22 and building wall 24 beneath the eaves trough 10.

Thus, the present invention provides an adapter which is not only inexpensive to make, but is ideally suited for mounting a conventional U-shaped eaves trough to a roof since it has the additional important attribute of providing a downwardly facing and substantially vertically aligned channel to receive the inner wall of a conventional eaves trough regardless of the pitch of the roof. Moreover, since the bending of the adapter to facilitate installation on a building regardless of the pitch of its roof does not deform the channel, the eaves trough can be easily and quickly installed regardless of the degree of altertness and skill of the workmen installing the adapter.

The foregoing detailed description is given primarily for clarity of understanding and no unnecessary limitations should be understood therefrom, for modifications will be obvious to those skilled in the art upon reading this disclosure and may be made without departing from the spirit of the invention or the scope of the appended claims.

I claim:

1. An adapter for securing an eaves trough to a roof of a building, said adapter comprising, a roof flange which abuts against an upper surface of said roof, a channel member having a channel of a predetermined width open at one end, and means for attaching said roof flange to said channel member so that said open end of said channel member faces downwardly while said roof flange flatly abuts against said upper surface of the roof, and wherein said means comprises means for adjusting the angle between the plane of said roof flange and the downwardly extending plane passing through the axis of the channel while maintaining the predetermined width of said channel.

2. The invention as defined in claim 1 wherein said first flange further comprises a coplanar drip flange portion extending over a portion of the opening of the eaves trough.

3. The invention as defined in claim 1 wherein said adapter is formed from a single resilient but deformable sheet.

4. The invention as defined in claim 3 wherein said adjusting means comprises at least one bend in said sheet.

5. An adapter for securing an eaves trough to a roof of a building, said adapter comprising, a first flange defining a roof engaging portion, channel means having a generally downwardly facing opening and comprising a first downwardly depending flange and a second downwardly depending flange substantially parallel to said first depending flange, wherein said first and second downwardly depending flanges are spaced apart a distance sufficient to permit insertion of a side wall of the eaves trough therein, means for securing said channel means to said first flange, and means for mounting the eaves trough to the roof, wherein said securing means comprises, means for securing said first depending flange to said first flange, means for securing said second depending flange to said first depending flange, and means for adjusting the angle between the plane of said first flange and the downwardly extending plane passing through the axis of said channel means, wherein said adjusting means comprises means for adjusting the angle between the plane of said first flange and the plane of said first depending flange, wherein said first depending flange and said second depending flange remain substantially parallel to each other as said first-mentioned angle is adjusted.

* * * * *

UNITED STATES PATENT AND TRADEMARK OFFICE

CERTIFICATE OF CORRECTION

PATENT NO. : 4,271,643

DATED : June 9, 1981

INVENTOR(S) : Ronald L. Sweers

It is certified that error appears in the above-identified patent and that said Letters Patent are hereby corrected as shown below:

Column 2, line 67, after "52", insert --54--;

Column 3, line 19, delete "61" and insert --57-- therefor.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*